US006093264A

United States Patent [19]

Hershberger et al.

[11] Patent Number: 6,093,264

[45] **Date of Patent: *Jul. 25, 2000**

[54] NICKEL-COPPER-BERYLLIUM ALLOY COMPOSITIONS

[75] Inventors: Charles Walter Hershberger, Loudon; Dennis Hall, Cleveland, both of Tenn.

[73] Assignee: NGK Metals Corporation, Reading, Pa.

[ * ] Notice: This patent is subject to a terminal disclaimer.

[21] Appl. No.: 09/365,675

[22] Filed: Aug. 2, 1999

Related U.S. Application Data

[63] Continuation of application No. 08/787,845, Jan. 23, 1997, Pat. No. 5,980,653.

[51] Int. Cl.[7] ..... C22C 19/05

[52] U.S. Cl. ..... 148/410; 148/409; 148/428; 420/441; 420/443; 420/459

[58] Field of Search ..... 420/443, 459, 420/441; 148/410, 409, 428

[56] References Cited

U.S. PATENT DOCUMENTS

| | | | |
|---|---|---|---|
| 811,239 | 1/1906 | Monell . | |
| 1,685,570 | 9/1928 | Masing et al. | 148/409 |
| 1,945,679 | 2/1934 | Corson | 148/410 |
| 1,986,585 | 1/1935 | Kroll | 148/410 |
| 3,228,095 | 1/1966 | Bird et al. | 148/428 |
| 3,343,949 | 9/1967 | Wikle . | |
| 3,464,817 | 9/1969 | Griffiths . | |
| 3,578,440 | 5/1971 | Eiselstein et al. . | |
| 3,704,182 | 11/1972 | Griffiths et al. . | |
| 4,073,667 | 2/1978 | Caron et al. . | |
| 4,556,534 | 12/1985 | Burnett et al. | 420/452 |
| 4,657,601 | 4/1987 | Guha . | |
| 4,852,880 | 8/1989 | Kobayashi . | |
| 4,951,953 | 8/1990 | Kim | 473/320 |
| 4,965,656 | 10/1990 | Koubuchi et al. . | |
| 5,089,067 | 2/1992 | Schumacher . | |
| 5,695,410 | 12/1997 | Brown | 473/315 |
| 5,980,653 | 11/1999 | Hershberger et al. | 148/410 |

FOREIGN PATENT DOCUMENTS

| | | | |
|---|---|---|---|
| 50-053226 | 5/1975 | Japan | 420/443 |
| 51-006815 | 1/1976 | Japan | 420/443 |
| 51-009020 | 1/1976 | Japan . | |
| 55-125249 | 9/1980 | Japan . | |

OTHER PUBLICATIONS

CAbs. 82:159588 of SU447,449 (Oct. 1974).

Erik Oberg, et al., *Machinery's Handbook*, 22nd Revised Edition, "Non–Ferrous Alloys," (1984),pp 2262–2265.

Eugene A. Avallone, Ed., et al., *Marks' Standard Handbook for Mechanical Engineers*, Ninth Edition, "Nonferrous Metals," (1987), pp. 6–70 through 6–74.

"Nickel–Base Corrosion– and Heat–Resistant Alloys—1," Chapter 3, pp. 32–57 (date unknown).

T. Lymen, ed., *Metals Handbook, 8th Ed.*, (1967), p. 790.

D. Lide, Ph.D, ed., *CRC Handbook of Chemistry and Physics, 75th ed.*, (1994), p. 12–112.

*Primary Examiner*—John Sheehan

*Attorney, Agent, or Firm*—Akin, Gump, Strauss, Hauer & Feld, L.L.P.

[57] ABSTRACT

A nickel-based alloy composition is disclosed comprising from about 0.05 to about 3 percent by weight beryllium; from about 1 to about 40 percent by weight copper; no greater than about 10 percent by weight chromium, the balance being nickel. The alloy composition may be adjusted to achieve a high, as-cast hardness alloy over a wide range of alloy component contents, or a moderate, as-cast hardness alloy useful for forming articles such as golf clubs which has relatively constant mechanical properties over a wide range of copper contents.

10 Claims, No Drawings

NICKEL-COPPER-BERYLLIUM ALLOY COMPOSITIONS

CROSS REFERENCE TO RELATED APPLICATION

This application is a continuation of co-pending application Ser. No. 08/787,845, filed Jan. 23, 1997, entitled Nickel-Copper-Beryllium Alloy Compositions now U.S. Pat. No. 5,980,653. The entire disclosure of application Ser. No. 08/787,845 as filed is incorporated herein by reference.

BACKGROUND OF THE INVENTION

There are various types of nickel-based alloys. One such alloy family known for its strength properties and corrosion resistance is the "Monel" alloy family. Monel alloys are nickel-copper based alloys. While these alloys are weldable, they are not known for being flexible with respect to alloy castability. Such alloys typically include about ⅔ wt % nickel and about ⅓ wt % copper. The basic Monel alloy is Monel 400 which has a composition of 66.5 wt % nickel, 31.5 wt % copper, 0.15 wt % carbon, 1.0 wt % manganese, 1.25 wt % iron, 0.12 wt % sulfur and 0.25 wt % silicon. Variations of the basic Monel alloy include Monel 404 which has low magnetic permeability and good brazing characteristics, Monel R-405 which includes additional sulfur for improved machining, and Monel K-500 which is an age-hardened Monel 400 having increased strength and hardness. Another Monel alloy exhibiting excellent hardness properties is S-Monel which includes 30 wt % copper, 0.15 wt % carbon, 1.5 wt % manganese, 3.5 wt % iron, 0.3 wt % sulfur and 4.0 wt % silicon, the balance being nickel.

Another available class of nickel-based alloy available which exhibits excellent castability properties and is useful for forming tools, machine parts and other items, including golf clubs, is nickel-beryllium alloys such as Berylco® 41C available from NGK Berylco. This alloy includes about 2.75 wt % beryllium, 0.7 wt % chromium and the balance nickel.

In forming golf clubs, various alloys are used, primarily stainless steel, nickel-beryllium, copper-beryllium and various bronze alloys. While the nickel-beryllium alloys provide desired color, appearance, smoothness, and good casting properties, including the desired density and hardness when treated, these alloys can be somewhat expensive due to the amount of nickel used in forming the alloy. For certain uses, for example for forming golf clubs, it is also sometimes necessary to subject nickel-beryllium alloys to further treatment steps to achieve the desired levels of hardness and strength.

There is a need in the art for a nickel-based alloy which is economical to manufacture, has the desired color, appearance, smoothness, and castability for various uses, particularly for use in forming golf clubs. There is further a need for a nickel-based alloy which achieves flexibility with respect to the various hardness levels which can be achieved for different alloy applications in the as-cast state without the need for further processing.

SUMMARY OF THE INVENTION

The invention includes a nickel-based alloy composition, comprising from about 0.05 to about 3 percent by weight beryllium; from about 1 to about 40 percent by weight copper; no greater than about 10 percent by weight chromium, and the balance being nickel.

In one embodiment, the invention includes a nickel-based alloy composition, comprising from about 0.05 to about 3 per cent by weight beryllium, from about 1 to about 30 percent by weight copper, no greater than about 1 percent by weight chromium, from about 0.1 to about 4 percent by weight silicon, and no greater than about 0.05 percent by weight iron, and the balance being nickel.

In a further embodiment, the invention includes a nickel-based alloy composition, comprising from about 0.5 to about 3 percent by weight beryllium, from about 25 to about 40 percent by weight copper, no greater than about 1 percent by weight chromium, from about 0.05 to about 4 percent by weight silicon, from about 0.025 to about 3.5 percent by weight iron, the balance being nickel.

An improvement to a method for making a golf club by forming the golf club from an alloy is also included in the invention. The improvement comprises using an alloy which comprises from about 0.05 to about 3 percent by weight beryllium; from about 1 to about 40 percent by weight copper; no greater than about 1 percent by weight chromium, from about 0.05 to about 4 percent by weight silicon, no greater than about 3.5 percent by weight iron, and no greater than about 0.25 percent by weight aluminum, and the balance being nickel.

DETAILED DESCRIPTION OF PREFERRED EMBODIMENTS

The present invention includes a nickel-based alloy composition which has excellent castability, is economical and provides a wide range of available hardness levels for different uses. By adjusting the beryllium and/or other elements of the alloy within preferred ranges, the nickel-based alloys of the present invention can provide stable hardness properties and densities over varied ranges of nickel and copper contents. Such preferred alloy compositions also exhibit the desired color, appearance, smoothness and castability properties useful for forming golf clubs, including an as-cast Rockwell C Hardness of about 16–20 and an as-cast Rockwell B Hardness of about 95–100. In addition, by adjusting the amounts of elements within alternative preferred ranges, high hardness levels useful for other applications can be achieved. The alloys can be formulated to reach as-cast Rockwell C Hardness levels of from about 20–44 or greater.

The alloy composition of the invention is a nickel-copper-beryllium alloy composition which may include from about 1 to about 40 wt % copper. The dilution of the nickel-based alloy composition with copper provides additional corrosion resistance, improved conductivity, and renders the alloy more economical. Further a wide variation of mechanical properties may be created by various treatments performed on the cast alloy structure. Adjusting the beryllium content contributes to increasing the available freezing range and depressing the melting point of the alloy, particularly in comparison with standard nickel-copper based alloys to achieve more flexibility in casting properties.

By adjusting the levels of the components of the alloy composition of the present invention, the alloy composition can be made to form alloys having a moderate as-cast hardness which exhibit relatively constant mechanical properties over a relatively wide range of copper content and alloys having a high as-cast hardness exhibiting a wide range of mechanical properties. The alloy composition of the present invention can be formed such that there is interaction between silicon and beryllium in the nickel-copper matrix in the absence of iron, or including only a small amount of iron, to achieve moderate hardness levels. Such moderate hardness levels, coupled with improved castability provide excellent alloys for use in forming various articles, for example, golf clubs. Further, by providing additional iron, the interaction of the silicon, beryllium and iron in the nickel-copper matrix can provide an alloy with high levels of as-cast hardness which can vary depending on the amounts of copper and other elements in the alloy while still maintaining excellent castability. Therefore, the alloys of the present invention provide a varied range of properties in an as-cast condition such that further alloy treatment steps are optional and manufacturing is more cost effective. Further the alloy compositions are useful for many applications such as forming golf clubs, plastic injection molds, glass-forming dies and cast bushings.

The alloy composition includes from about 1 to about 40 wt % copper. If a moderate hardness, as-cast alloy is desired, such as for forming golf clubs and the like, the copper content of the alloy is preferably from about 1 to about 30, more preferably from about 5 to about 30 wt %. If a high hardness, as-cast alloy is preferred, the higher the copper content, the higher the hardness level as a result of the interaction of the beryllium with the copper-nickel matrix, specifically at the interaction of the copper-beryllium grain boundaries. For high hardness alloys, the copper content of the composition is preferably from about 25 to about 40 wt %, most preferably about 30 wt %.

The alloy includes from about 0.05 to about 3 wt % beryllium, preferably from about 1.8 to about 2 wt % beryllium, particularly if a more moderate hardness level alloy composition is desired or from about 0.5 to about 3 wt % if a higher as-cast hardness level is desired. Varying the level of beryllium in the nickel-copper matrix affects the hardness level of the alloy. In the presence of iron and silicon, varying the beryllium will cause the hardness to vary widely. In the absence of iron, the beryllium will contribute to relatively constant mechanical properties and a moderate as-cast hardness level.

The alloy preferably also includes silicon for fluidity in an amount of from about 0.05 to about 4 wt % silicon. For forming a moderate hardness alloy, the silicon level is preferably from about 0.4 to about 0.6 wt %, and for a higher hardness alloy, the silicon level should be greater, most preferably about 3 wt %.

The alloy also preferably includes a low level of chromium, which may contribute to increasing hardness, but also is desirable for forming articles from the as-cast alloys which require a specific coloring. The greater the chromium content, the more white the color of the alloy. While the alloys may tolerate up to about 10 wt % chromium, due to the cost and effect of the chromium on hardness and coloration, it is preferred that the chromium level be maintained as no greater than about 2 wt %, and more preferably from about 0.025 to no greater than about 1 wt %. For use in forming golf clubs or similar articles and/or for forming a moderate hardness level alloy, the chromium content is preferably from about 0.45 to about 0.55 wt %. for higher hardness alloys, the chromium content is preferably between about 0.75 and about 1 wt % chromium.

Iron is an optional element in the alloy compositions of the invention. It is not a preferred component of the alloy if a more moderate hardness level is to be achieved. If iron is added to form a moderate hardness composition, it should be kept at impurity levels of no greater than about 0.05 wt %, and preferably no greater than about 0.025 wt %. If a higher hardness alloy is desired, iron may be added in amounts of from about 0.025 to about 3.5 wt %, more preferably about 1 wt %.

Another optional element in the alloy composition is aluminum which may be added to the alloy to contribute to hardness and castability if a moderate hardness alloy is to be achieved at amounts of up to about a 0.25 wt % maximum.

The balance of the alloy is nickel, however, the alloy may also include any other elements or impurities commonly found in nickel-based, copper-based or copper-beryllium-based alloys which do not interfere with the interaction between the beryllium and nickel-copper matrix. Preferably such elements and/or impurities are present in amounts no greater than about 0.5 wt % individually.

The alloy may be formed by any method of melting and casting. Further, if the alloy is subjected to re-melting, the beryllium in the alloy contributes to increasing the freezing range and depressing the melting point of standard nickel-alloys such that it is easier to process the alloy composition which is softened as cast. Further, while the alloy composition exhibits excellent as-cast properties, it may also be further processed by heat treating and quenching at temperatures generally of from about 500° C. to about 1100° C., and then optionally age-hardening the alloy for a period of time of from about 0.5 to about 5 hours, preferably from about 1 hour to about 1 hour and 25 minutes at a temperature of from about 300° C. to about 1100° C., preferably about 1060° C. to achieve a softer alloy for casting. By providing such addition thermal treatment steps, the alloy compositions of the present invention can achieve Rockwell C Hardness levels as low as between 4 and 10 (corresponding to Rockwell A Hardness levels as low as between 50.5 and 53.5). Such additional treatments is optional, however, in view of the excellent as-cast properties of the alloy.

Based on the foregoing, one preferred embodiment of the alloys of the present invention includes a moderate hardness alloy composition having excellent castability and relatively stable mechanical properties. The composition includes from about 0.05 to about 3 wt % beryllium, from about 1 to about 30 wt % copper, no greater than about 1 wt % chromium, from about 0.1 to about 4 wt % silicon, and no greater than about 0.05 wt % iron, the balance being nickel. More preferably, the moderate hardness alloy composition includes up to 0.25 wt % aluminum, from about 1.8 to about 2 wt % beryllium, from about 5 to about 30 wt % copper, from about 0.45 to about 0.55 wt % chromium, from about 0.4 to about 0.6 wt % silicon, and no greater than about 0.025 percent by weight iron.

In another preferred embodiment of the present invention directed more particularly to forming higher hardness alloys, the present invention includes a composition including from about 0.5 to about 3 wt % beryllium, from about 25 to about 40 percent wt % copper, no greater than about 1 wt % chromium, from about 0.05 to about 4 wt % silicon, and from about 0.025 to about 3.5 wt % iron, with the balance being nickel.

The present invention also includes a method for making a golf club. In the method, the golf clubs may be formed by any suitable method, preferably by conventional lost wax investment casting. The method further includes the improvement of forming the golf club from an alloy according to the present invention as described in detail above. Preferably, a moderate hardness alloy composition according to the present invention is used to facilitate castability of the golf club, and to provide the desired color level for forming golf clubs, which in one preferred application includes a color range of from about 2 to about 4 on a scale of 1 to 10, with 1 being the most white in color and 10 being the most yellow.

The invention will now be described in detail with respect to the following non-limiting examples:

COMPARATIVE EXAMPLE 1

A nickel-beryllium alloy was formed including 2.75 wt % beryllium and 0.70 wt % chromium, the balance nickel. The alloy was formed by melting nickel, chromium and beryllium, These elements were formed from pre-alloyed ingots, however, they may also be formed from individual raw materials. Direct reading spectrograph and inductively coupled plasma analytical techniques were used to verify elemental composition of this composition and throughout the following examples. The hardness level of this alloy and of the alloys of the following examples were tested using a commercially available, recently calibrated, Willson hardness tester capable of hardness readings on both the Rockwell C (RHc) and Rockwell B (RHb) scales. The density of this alloy and of the alloys of the following examples were measured by measuring the displacement of one milliliter of deionized water by a one gram sample of alloy using standard commercial practices. The as-cast Rockwell C Hardness of the nickel-beryllium alloy was 25 and the density was 8.214 g/cm$^3$. The alloy was also evaluated for color on a scale of 1–10 with 1 being the most white-colored and 10 being the most yellow-colored alloy. The alloy color was approximately 3.

COMPARATIVE EXAMPLE 2

A commercial S-Monel having 3.60 wt % silicon, 1.60 wt % iron, 30.7 wt % copper and the balance nickel was also evaluated as described in Comparative Example 1 for hardness. The hardness level of as-cast S-Monel is 34.

INVENTIVE EXAMPLE 1–12

Alloys according to the present invention were made according to the same method described in Comparative Example 1 and having the compositions as shown in Table 1 below. The hardness levels were evaluated for each alloy sample, and the pouring temperatures were evaluated for alloys of Inventive Examples 1–9. In addition, the density of the alloys of Inventive Examples 4, 5 and 7–10 were evaluated. The fluidity level was also objectively evaluated to determine if fluidity was medium or high at the pouring temperature. The alloy color were also objectively evaluated.

Based on the test results, it can be seen that alloys having silicon, iron and beryllium in the nickel-copper matrix exhibited very high as-cast Rockwell C Hardness levels. In addition, the other alloys exhibited relatively constant hardness, density and fluidity properties even in the complete absence of iron and the presence of very little silicon. The color of alloys 8 and 10, in addition to the mechanical properties of those alloys renders them excellent for casting and forming cast articles such as golf clubs and the like.

TABLE 1

| Alloy Inv. Ex. No. | 1 | 2 | 3 | 4 | 5 | 6 | 7 | 8 | 9 | 10 | 11 | 12 |
|---|---|---|---|---|---|---|---|---|---|---|---|---|
| Be | 2.75 | 2.00 | 1.00 | 1.80 | 1.00 | 2.50 | 1.80 | 1.80 | 1.80 | 1.80 | 2.00 | 1.80 |
| Cr | 0.70 | 0.70 | 0.70 | 0.50 | 0.50 | 0.50 | 0.50 | — | 0.50 | 0.50 | — | — |
| Si | 3.00 | 3.00 | 3.00 | 1.00 | 1.00 | — | — | 0.50 | 0.50 | 0.50 | 0.50 | 0.50 |
| Fe | 1.00 | 1.00 | 1.00 | 0.50 | 0.50 | — | — | — | — | — | — | — |
| Cu | 30.00 | 30.00 | 30.00 | 15.00 | 15.00 | 30.00 | 15.00 | 5.00 | 5.00 | 5.00 | 5.00 | 15.00 |
| Al | — | — | — | — | — | — | 0.20 | — | — | — | — | — |
| Ni | Bal. | Bal. | Bal. | Bal. | Bal. | Bal. | Bal. | Bal. | Bal. | Bal. | Bal. | Bal. |
| Results | | | | | | | | | | | | |
| As-Cast RHc | 44.5 | 42 | 38 | 18.75 | 19 | 20 | 19 | 16 | 18 | 18.5 | 19.5 | 20 |
| Dens. (g/cm$^3$) | | | | 9.2282 | 9.1697 | | | 9.0346 | 9.3822 | 9.0136 | | |
| Pour T (° C.) | 1343 | 1343 | 1343 | 1427 | 1427 | 1443 | 1427 | 1427 | 1427 | 1427 | 1454 | 1427 |
| Fluidity | High | High | High | Med. | Med. | High | High | Med. | Med. | Med. | Med. | Med. |
| Color | 5 | 7 | 6 | 4 | 3 | 9 | 10 | 2 | 8 | | | |

It will be appreciated by those skilled in the art that changes could be made to the embodiments described above without departing from the board inventive concept thereof. It is understood, therefore, that this invention is not limited to the particular embodiments disclosed, but it is intended to cover modifications within the spirit and scope of the present invention as defined by the appended claims.

What is claimed is:

1. A nickel-based alloy composition, comprising from about 0.05 to about 3 percent by weight beryllium; from about 15 to about 40 percent by weight copper; no greater than about 10 percent by weight chromium; no greater than 3.5 percent by weight iron, balance being nickel, wherein the composition comprises at least about 50 percent by weight nickel.

2. A nickel-based alloy composition, comprising from about 0.05 to about 3 percent by weight beryllium; from about 1 to about 40 percent by weight copper; no greater than about 1 percent by weight chromium; no greater than 3.5 percent by weight iron, the balance being nickel, wherein the composition comprises at least about 50 percent by weight nickel.

3. The alloy composition according to claim 1, comprising from about 0.025 to about 3.5 percent by weight iron.

4. The alloys composition according to claim 1, comprising no greater than about 0.05 percent by weight iron.

5. The alloy composition according to claim 4, comprising no greater than about 0.025 percent by weight iron.

6. The alloy composition according to claim 2, comprising from about 1 to about 30 percent by weight copper.

7. The alloy composition according to claim 6, comprising from about 5 to about 30 percent by weight copper.

8. The alloy composition according to claim 1, comprising from about 1.8 to about 2 percent by weight beryllium.

9. The alloy composition according to claim 1, comprising from about 0.5 to about 3 percent by weight beryllium.

10. The alloy composition according to claim 1, comprising from about 15 to about 30 percent by weight copper.

* * * * *